United States Patent [19]

Amendola

[11] 4,369,107

[45] Jan. 18, 1983

[54] SEPARATION OF SUPER-ACID IN A COAL LIQUIFICATION PROCESS

[76] Inventor: Steven C. Amendola, 11 Thornwood Pl., Scarsdale, N.Y. 10583

[21] Appl. No.: 275,497

[22] Filed: Jun. 19, 1981

[51] Int. Cl.[3] ..... C10G 1/06; C10G 47/02; C10J 1/20; C10J 3/00

[52] U.S. Cl. ..... 208/10; 208/112; 48/197 R; 48/210

[58] Field of Search ..... 208/10, 112; 48/197 R, 48/210

[56] References Cited

U.S. PATENT DOCUMENTS

| | | | |
|---|---|---|---|
| 1,925,551 | 9/1933 | Wietzel et al. | 196/13 |
| 1,959,175 | 5/1934 | Pier et al. | 196/53 |
| 2,119,647 | 6/1938 | Pier et al. | 196/53 |
| 2,352,236 | 6/1944 | Thomas | 196/39 |
| 2,966,450 | 12/1960 | Kimberlin, Jr. et al. | 208/10 |
| 3,247,092 | 4/1966 | Huntington | 208/8 |
| 3,542,665 | 11/1970 | Wold | 208/10 |
| 3,700,583 | 10/1972 | Solamony et al. | 208/10 |
| 3,764,515 | 10/1973 | Kiovsky | 208/10 |
| 3,796,650 | 3/1974 | Urban | 208/10 |
| 4,036,738 | 7/1977 | Wristers | 208/108 |
| 4,089,772 | 5/1978 | Gorbaty et al. | 208/10 |
| 4,090,944 | 5/1978 | Moore et al. | 208/10 |
| 4,092,235 | 5/1978 | Schlosberg et al. | 208/10 |
| 4,202,757 | 5/1980 | Amendola | 208/10 |

*Primary Examiner*—Delbert E. Gantz
*Assistant Examiner*—William G. Wright
*Attorney, Agent, or Firm*—Brumbaugh, Graves, Donohue & Raymond

[57] ABSTRACT

This invention relates to an improved process for rapidly converting essentially solid carbonaceous material to essentially liquid and gaseous hydrocarbon products wherein a rapid and economical method of separating the components of the super-acid system from the liquified hydrogenated products is used.

12 Claims, 2 Drawing Figures

SEPARATION OF SUPER-ACID IN A COAL LIQUIFICATION PROCESS

BACKGROUND OF THE INVENTION

The vast reserves of coal in this country and throughout the world, have prompted and continue to prompt considerable interest and investigation into economical processes for the transformation of coal solids into liquid products that can be upgraded to provide synthetic petroleum fractions.

U.S. Pat. No. 4,202,757 (the '757 patent) incorporated herein by reference, describes a process believed to represent a major break through in coal liquification technology, largely due to the fact that the process is designed to be carried out under normal atmospheric pressure. An improvement in this process has now been discovered whereby the components of the essential superacid system used in the process can be quickly and economically separated from the liquid hydrocarbon products, recovered and reused.

The process which is fully described in U.S. Pat. No. 4,202,757 rapidly converts coal as well as other fossil fuel sources such as oil shale or tar sands to valuable liquid hydrocarbon products. The '757 process is designed to operate with a low energy input at relatively low temperatures and atmospheric pressure, and thus, is far more economical than other processes presently known and used in synthetic petroleum technology. A potential drawback of the '757 process is that the recovery of the super-acid system is low. The present invention provides a novel process for the retrieval of the super-acid system from the hydrocarbons which make the overall process more economical.

In the process of the '757 patent, pulverized coal is initially reacted with acids, such as hydrogen halides, hydrogen pseudohalides and sulphonates in accordance with the following reaction scheme:

$$R + HX \xrightarrow[\text{(heat)}]{\text{(solvents)}} RHX; \quad (1)$$

wherein R represents unsaturated bonds in the coal and HX is the general formula of the particular acid used. A critical parameter in choosing a suitable acid (HX) is that the acid molecules must be capable of donating a negative ligand to a strong Lewis acid in order to form carbonium ions. [See reaction (4) and related discussion, infra.] Suitable acids for the initial phase of the coal liquification process include hydrogen chloride, chlorosulphonic acid, hydrogen fluoride, fluorosulphonic acid, hydrogen bromide, hydrogen iodide, sulphuric acid. Combinations of such acids are also contemplated for use in the initial reaction, however, hydrogen chloride and hydrogen fluoride are the preferred acids for use in this first phase of the coal liquification process. The specific details of this first phase addition reaction are disclosed in U.S. Pat. No. 4,202,757.

In the second phase of the '757 coal liquification process, the RHX (slurry) from reaction (1) is reacted with a Lewis acid, halide-ion-acceptor system, a.k.a. super-acid system, e.g. antimony pentafluoride in hydrogen fluoride. Group V halides are preferred for use in said system and include, inter alia, antimony pentachloride, antimony pentafluoride, bismuth pentafluoride, arsenic pentafluoride, phosphorous pentafluoride and phosphorous pentachloride. The bromides and iodides of the Group V elements are not as efficient in their Lewis acid properties as the acid outlined above and not all of them are known to exist in the pentavalent state. Chemical compounds wherein there are some fluorines and chlorines on the same atoms are also suitable, e.g. $SbCl_2F_3$ or $SbCl_3F_2$. A general formula for the suitable Group V halide compounds is:

$$MX_nY_m \quad (2)$$

wherein M is a Group V atom in the +5 oxidation state and X and Y are halogens which can be the same ($SbF_5$) or different ($SbClF_4$) and the sum of n and m equal 5. As a further criterion, the compound must have sufficient Lewis acidity to effect the following reaction:

$$MX_nY_m + RHX \longrightarrow \underset{\text{(carbonium ion)}}{[RH]^+} + [MX_{n+1}Y_m]^- \quad (3)$$

Suitable acids for use in the super-acid system include hydrogen fluoride, hydrogen chloride, chlorosulphonic acid and fluorosulphonic acid. The equivalent bromo and iodo acids are also suitable, although not preferred due to their lower reactivities and the undesirable problem of oxidizing the bromide and iodide ions to their elemental state. While many effective super-acid systems will be apparent to those skilled in the art, representative systems include combinations of the acids such as HF and $HSO_3F$ with $SbF_5$. The metal pentahalides can also be combined, for instance $SbF_5$ and $BiF_5$ (thus trinary, quaternary or even higher orders of systems are feasible). Other systems may include halide ion-acceptors such as pentaphenylbismuth $(C_6H_5)_5Bi$ or phenyl tetrachloroantimony $C_6H_5SbCl_4$. Furthermore, super-acid systems may be solid rather than liquid, such as $SbF_5$ with $TiO_2$ (titanium dioxide) or $SbF_5$ with $SiO_2$ (silicon dioxide).

The reactions in the second phase of the '757 process are believed to proceed in accordance with the following reaction scheme and are discussed in detail in the '757 patent specification:

$$RHX + 2SbX_5 + 2HX \rightarrow RH^+ + 2SbX_6^- + H_2X^+ \quad (4)$$

$$RH^+ + R^1H \rightarrow RH_2 + R^1 \quad (5)$$

$$2SbX_6^- + 2H_2X^+ \rightarrow 4HX + 2SbX_5 \quad (6)$$

As a result of the reaction of RHX with the super-acid system (3) (4), carbonium ions are formed which when reacted with a suitable hydrogen donor source yield commercially valuable, liquified, hydrogenated products (5). These liquid hydrocarbon products must, thereafter, be separated from any remaining solids as well as separated from the components of the super-acid system, which can be recycled to make the process continuous. To date, conventional techniques for separating the super-acid system from the hydrocarbons have proved unsatisfactory. The invention of the present application provides a novel super-acid separation step which operates compatibly with the basic '757 liquification/gasification process.

SUMMARY OF INVENTION

The present invention provides an improved process for rapidly converting essentially solid carbonaceous material to essentially liquid and gaseous hydrocarbon products wherein a rapid and economical method of separating the components of the super-acid system from the liquified hydrogenated products is used. The process comprises a first phase of reacting said solid material with at least one acid to form carbon addition products, and a second phase of reacting products of the first phase reaction with a Lewis acid, halide-ion-acceptor (super-acid) system and hydrogen donor source (hydrogenation), and wherein the acid or acid combinations used in the first phase is capable of donating a negative ligand to the Lewis acid in the second phase in order to form carbonium ions, wherein the improvement comprises separating the components of the super-acid system from the hydrocarbon products by (1) Obtaining the lighter fractions of the resulting hydrocarbon product which contain the super-acid system;

(2) combining the fraction thus obtained with a salt capable of forming a heat reversible, hydrocarbon insoluble, double salt with the components of the super-acid;

(3) separating the insoluble double salt which forms from the hydrocarbon product; and (4) heating the insoluble double salt to its decomposition point in order to volatize the components of the super-acid system.

DETAILED DESCRIPTION OF THE INVENTION

In the coal liquification process described in the '757 patent (FIG. 1) pulverized coal (R) is supplied to Reactor No. 1, and contacted therein with hydrogen chloride, or another suitable acid supplied from vessel 16 through line 14, and anthracene oil from a source not shown. The slurry mixture formed is heated to a temperature of about 390° C. to accelerate the formation of carbon addition products (RHCl). The slurry and carbon addition products once formed, are then pumped through line 18 to a second reaction chamber, Reactor No. 2.

A suitable Lewis acid, halide-ion-acceptor system (super-acid system), for example a mixture of chlorosulphonic acid and antimony pentachloride (85% acid and 15% metal halide), is introduced into Reactor No. 2 through line 20 from vessel 22. Thereafter a hydrogen donor source, for example, a highly reactive, low boiling point branched alkane (containing no more than six (6) carbom atoms) is introduced into Reactor No. 2 from vessel 26 through line 24.

The reaction in Reactor No. 1, i.e., the formation of the addition products designated RHX, takes place at one atmosphere and at a temperature of about 390° C. The reaction of the carbon addition products (RHX) and the super-acid system and the subsequent hydrogenation with the branched alkane in Reactor No. 2 also occurs at one atmosphere, but at a lower temperature—equal to the boiling point of the acid, i.e. the chlorosulphonic acid of the super-acid system. As noted earlier, the use of a hydrogen atmosphere is preferred in Reactor No. 2.

Gaseous reaction products produced, as a result of the reactions in Reactor No. 2 pass through line 28 to a separator 30 wherein hydrogen chloride, methane and alkenes are separated. Hydrogen chloride is passed through line 32 to vessel 16 for reuse in Reactor No. 1; methane is recovered through line 34 and the alkenes are decontaminated and passed through line 36 to Reactor No. 3 wherein they are hydrogenated to alkanes.

The liquified, hydrogenated products along with unreacted solids and other reaction products produced in accordance with the various reactions in Reactor No. 2 are transferred through line 38 to vessel 40 for distillation and separation according to the improvement of this invention. The hydrocarbon products in the vessel 40 are distilled and the fractions containing the major portion of the super-acid system are removed from the distillate. The inorganic super-acid components are soluble in the hydrocarbon fraction because the super-acid system components are covalent. The remaining crude oil fraction is processed as described in the '757 patent.

The distillate fraction to be removed from vessel 40 is determined by the boiling point range of the super-acid system which is used in the liquification process. For the $SbF_5$ and HF system at one atmosphere the 15°–25° C. fraction and the fraction which distills at about 145°–155° C. is removed; for the $SbF_5$ and $FSO_3H$ system at one atmosphere the fraction distilling at about 128°–150° C. is removed. These are only estimates of the distillation temperatures. The exact distillation temperature range of each system will vary and should be separately determined for each super-acid system and process.

The hydrocarbon fractions containing the super-acid are treated with potassium fluoride preferably at least 150 mole % potassium fluoride (1.5 moles KF for each mole of the components of the super-acid system). The KF reacts with the super-acid system components to form a hydrocarbon insoluble double ionic salt. The insoluble double salt is removed and the crude oil remains. Although potassium fluoride is the preferred salt for use in this process, any salt would be suitable which will form a hydrocarbon insoluble double ionic salt with the super-acid components which salt is heat reversible and which with the application of heat will decompose into the components of the super-acid system. Examples of other useful salts are CsF, RbF, $CoF_3$, $AlF_3$, $NH_4F$ and $NH_4HF_2$.

The liquid hydrocarbon product from the '757 process can be treated with potassium fluoride in either a vat batch process or in a continuous system. In the batch system the distillation fraction containing the liquid hydrocarbon and super-acid is removed and mixed with the appropriate (1.5 moles/mole of super-acid) amount of potassium fluoride. The resulting insoluble double salt is separated from the liquid hydrocarbon. In the continuous system the appropriate distillation fractions are removed from vessel 40 and continuously fed into a column containing KF. The insoluble double salt forms in the column and the distillation fraction, free of the super-acid components, flows through the column and is collected for further processing. If a continuous processing system is used the amount of the super-acid being introduced and the amount of unreacted KF in the column must be known and the KF column replaced with a fresh column containing unreacted KF when there is not a sufficient excess of unreacted KF in the column to react with the super-acid components being introduced. The preferred ratio of acid to KF is 1:1.5.

The super-acid system components react with the potassium fluoride as follows:

$$MX_nY_m + 1.5KF \rightarrow KMX_nY_mF\downarrow + 0.5KF \quad (7)$$

$$HX + 1.5KF \rightarrow KHXF\downarrow + 0.5KF \quad (8)$$

wherein M is a group V atom in the +5 oxidation state and X and Y are selected from the group consisting of halogens, sulfates or nitrates which can be the same ($SbF_5$) or different ($SbClF_4$) and the sum of n and m equal 5.

The double salt which forms is separated from the hydrocarbon products. The potassium fluoride and the super-acid system components are recovered from the insoluble double salt by heating the isolated salt to the point at which the double salt decomposes into the super-acid components which boil off. For KF and $SbF_5$/HF the temperature is about 300° C.-330° C. The reaction is carried out in a retort in order to recover the super-acid system components. The recovery temperature, i.e., the decomposition temperature of the double salt, varies for each super-acid system and can be readily determined by consulting a table of physical properties for each super-acid system. For example $KSbF_6$ decomposes at about 290° C. and $KHF_2$ decomposes at about 300° C. Decomposition temperatures are approximate and depend on the speed and evenness of the heat distribution. In order to avoid decomposition of the super-acid system components the decomposition of the double salt can also be carried out at reduced pressure.

The super-acid components obtained by the decomposition of the double salts are condensed by conventional means and reintroduced into the coal liquification process (Reactor No. 2). The regenerated potassium fluoride is returned to a separation column for reuse in the process. About 95% of the super-acid system components are recovered by this process.

The separation process according to the present invention requires only the energy needed to distill the appropriate hydrocarbon fractions and to decompose the double salt and, therefore, provides an economical and simple method for separating the components of the super-acid system from the liquid hydrocarbon end products.

Figure 1:
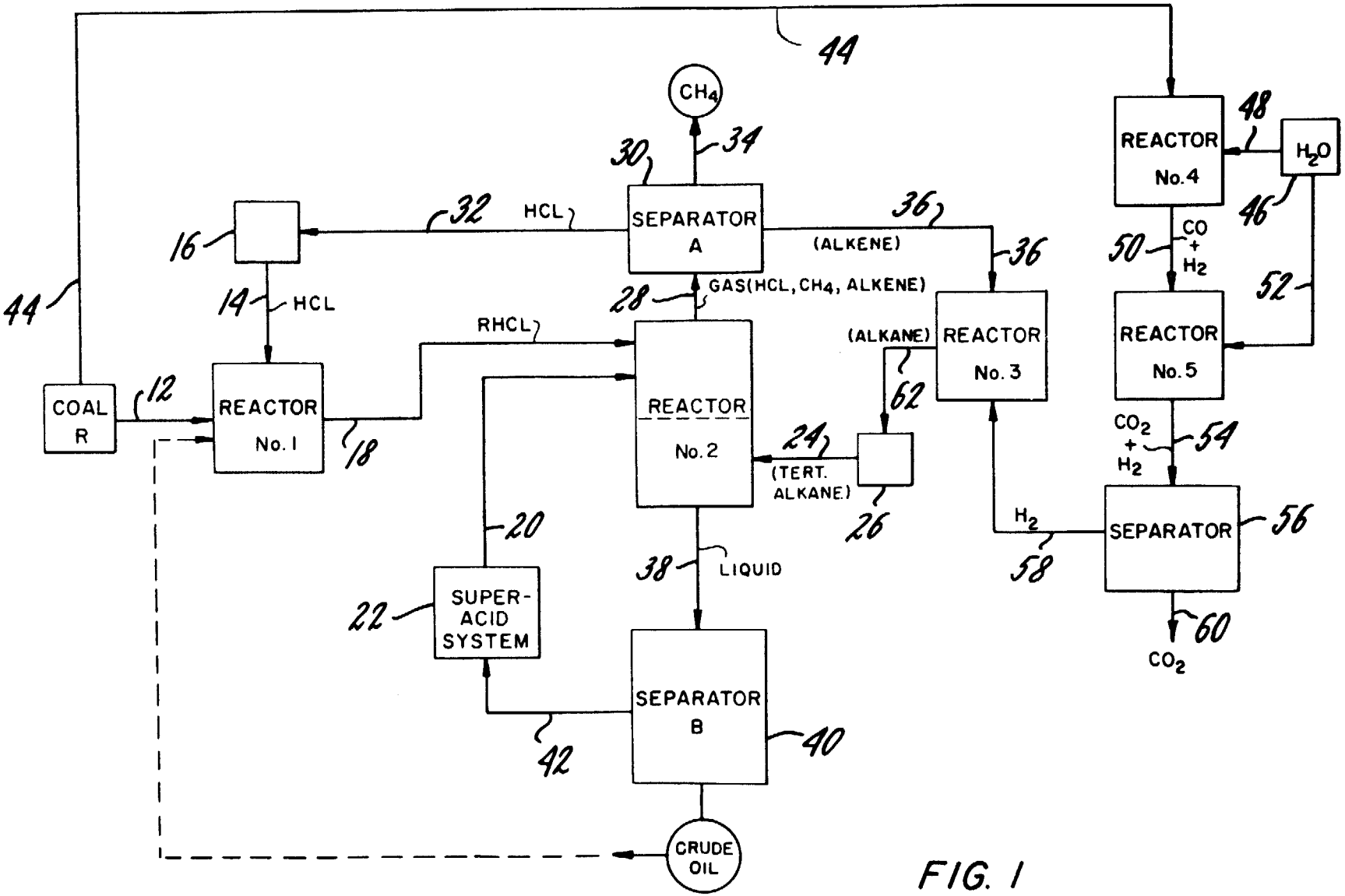
FIG. 1 illustrates a flow diagram representing the process of the '757 invention.
Figure 2:
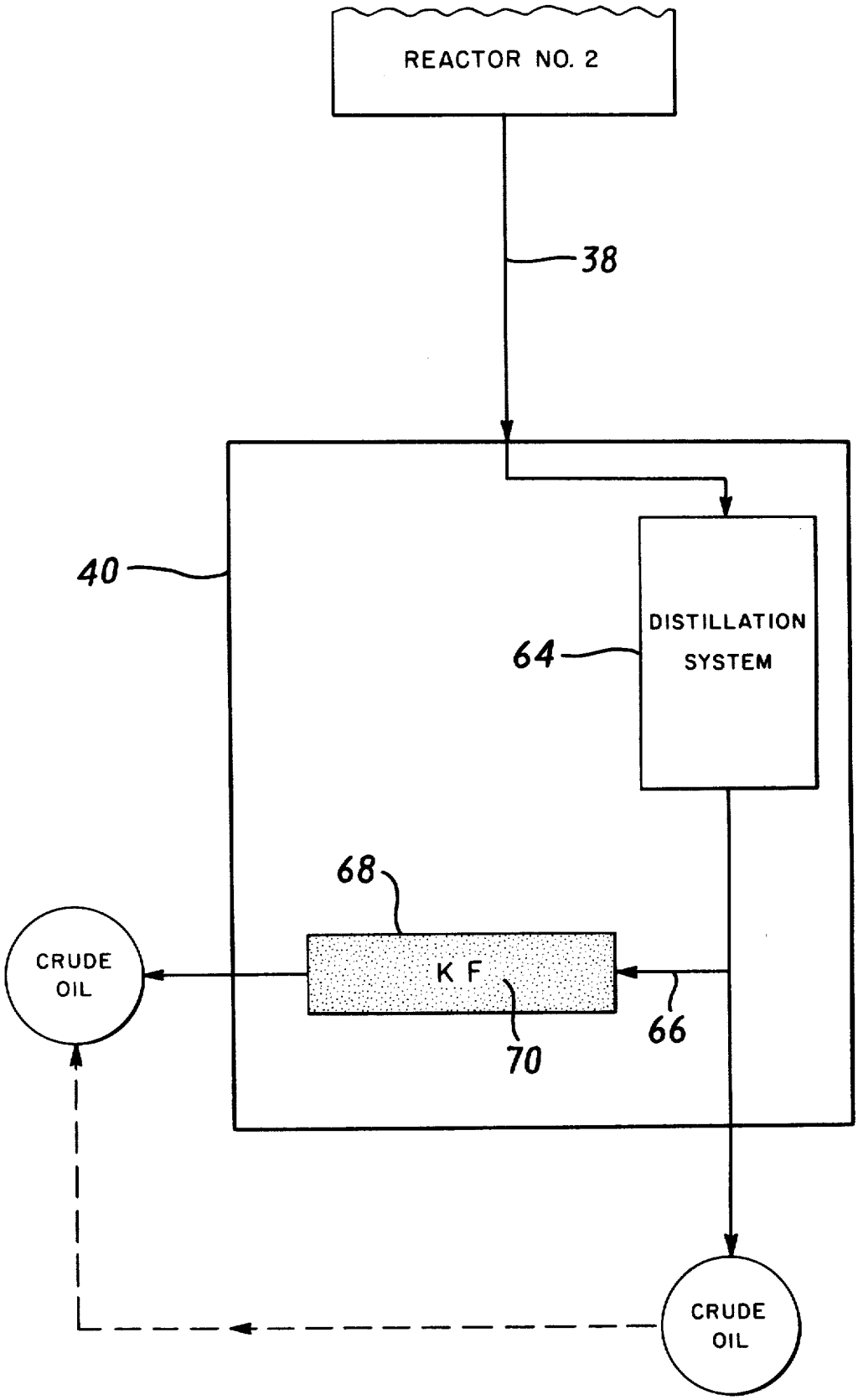
FIG. 2 illustrates the improved Separator B from FIG. 1.

Since the drawings are highly schematic, they do not illustrate heaters, pumps, valves, instrumentation and other conventional equipment that would normally be employed in such a process.

DESCRIPTION OF PREFERRED EMBODIMENT

The liquified hydrogenated products along with unreacted solids and other reaction products produced in the '757 process using $SbF_5$ and HF as the super-acid are transferred through line 38 to vessel 40 for distillation in a column 64. The fractions which distill at about 15°-25° C. and 145° C.-155° C. are removed from vessel 40 through line 66 and passed through a column 68 containing KF 70. The flow through the column is monitored and the column is changed when significant amounts of acid components appear in the effluent. The distillation fraction flows through KF column 68 free from the super-acid system components to be processed (i.e. Reactor No. 1).

The reacted KF column 68 is removed from the system and replaced by a fresh KF column and the insoluble double salt 70 formed in the first column 68 is heated to about 300° C. in a retort vessel at which point the $SbF_5$ and HF volatize. The super-acid components HF and $SbF_5$, are condensed and recovered. The recovered HF and $SbF_5$ can then be reintroduced into Reactor 2 for further use as the super-acid in the process.

It is understood that the process may be varied without departing from the scope or spirit of the invention. Although the process is preferably used in conjunction with the '757 coal liquifaction process, it may also be used in other processes where liquid petroleum is separated from metal halides and/or acids.

I claim:

1. An improved process for rapidly converting essentially solid carbonaceous material to essentially liquid and gaseous hydrocarbon products, comprising a first phase of reacting said solid material with at least one acid to form carbon addition products, a second phase of reacting products of the first-phase reaction with a Lewis acid, halide-ion-acceptor (super-acid) system and hydrogen donor source (hydrogenation), and wherein the acid or acid combinations used in the first phase is capable of donating a negative ligand to the Lewis acid in the second phase in order to form carbonium ions, wherein the improvement comprises separating the components of the super-acid system from the hydrocarbon products by a. Obtaining the fractions of the resulting hydrocarbon product which contain the super-acid system;
b. combining the fraction thus obtained with a salt capable of forming a heat, reversible, hydrocarbon insoluble, double salt with the components of the super-acid system;
c. separating the insoluble double salts which form from the hydrocarbon product; and
d. heating the insoluble double salt to its decomposition point in order to volatize the components of the super-acid system.

2. A process according to claim 1 wherein the fraction containing the super-acid system is obtained by distillation.

3. A process according to claim 1 wherein the salt capable of forming a heat reversible, hydrocarbon insoluble double salt with the components of the super-acid system is potassium fluoride.

4. A process according to claim 1 wherein the fraction of the hydrocarbon product which contains the super-acid system is combined with the salt in a molar ratio of about 1:1.5.

5. A process according to claim 1 wherein the volatized components of the super-acid system are condensed and reused in the process.

6. A process according to claim 1 wherein the heating of the insoluble double salt is conducted at a reduced pressure.

7. A process according to claim 1 wherein the carbonaceous material is coal, or another fossil fuel source.

8. A process according to claim 1 wherein the super-acid system comprises antimony pentachloride and chlorosulphonic acid, or antimony pentafluoride, bismuth pentafluoride and fluorosulphonic acid.

9. A process according to claim 1, wherein said process is made continuous through the recycling of the reagents used in the reactions.

10. A process according to claim 1 wherein the super-acid system comprises at least one Group V halide and at least one suitable acid and wherein the Group V halide has the general formula $MX_nY_m$, M being the Group V atom in the +5 oxidation state and X and Y being halogens which may be the same or different and the sum of n and m equaling five (5).

11. A process according to claim 10 wherein in the super-acid system the acid content is greater, as measured by mole/percent, than the Group V halide content.

12. A process according to claim 8, wherein 15% antimony pentachloride is combined with 85% chlorosulphonic acid; and where 12% antimony pentafluoride is combined with 3% bismuth pentafluoride and 85% fluorosulphonic acid.

* * * * *